US006416336B1

(12) United States Patent
Schulte et al.

(10) Patent No.: US 6,416,336 B1
(45) Date of Patent: Jul. 9, 2002

(54) ELECTRICAL CONNECTION TOWER AS A PUSH-IN PART

(75) Inventors: Siegfried Schulte, Lüdenscheid; Bernd Flackus, Miehlen, both of (DE)

(73) Assignee: Modelec S.A., Delemont (CH)

( * ) Notice: Subject to any disclaimer, the term of this patent is extended or adjusted under 35 U.S.C. 154(b) by 0 days.

(21) Appl. No.: 09/881,542

(22) Filed: Jun. 14, 2001

(30) Foreign Application Priority Data

May 7, 2001 (DE) ..... 101 22 123

(51) Int. Cl.[7] ..... H01R 13/44
(52) U.S. Cl. ..... 439/131; 439/142
(58) Field of Search ..... 439/131, 138, 439/142, 535, 650, 652; 174/48, 57

(56) References Cited

U.S. PATENT DOCUMENTS 3,972,579 A * 8/1976 Kohaut ..... 439/142
5,351,173 A * 9/1994 Byrne ..... 439/131
5,755,582 A * 5/1998 Charlton ..... 439/131
6,234,812 B1 * 5/2001 Ivers et al. ..... 439/131

* cited by examiner

*Primary Examiner*—Tho D. Ta
(74) *Attorney, Agent, or Firm*—Edwin D. Schindler

(57) ABSTRACT

An electrical connection tower as a push-in part with a plurality of receptacle outlet inserts for system voltage connections and for information connections, an annular surround which is recessed in a table top engaging with guides in rails of the connection tower and a cover arranged on the top of the connection tower closing off the top side of the annular surround. The technical problem is that of providing a connection tower with a flush termination of the equipment plate in the unused state and ease of handling. The cover can be swung up counter to a prestressing force about a hinge pin aligned parallel to the plane of an insert plate of a receptacle outlet insert on the insertion side of the insert plates.

6 Claims, 8 Drawing Sheets

ELECTRICAL CONNECTION TOWER AS A PUSH-IN PART

BACKGROUND OF THE INVENTION

1. Field of the Invention

The invention relates to an electrical connection tower as a push-in part with a plurality of receptacle outlet inserts for system voltage connections and for information connections, an annular surround which is recessed in a table top engaging with guides in rails of the connection tower and a cover arranged on the top of the connection tower closing off the top side of the annular surround.

2. Description of the Prior Art

A connection tower of this type provides the system voltage and/or information supply for movable data devices and other power consumers. A commercially available connection tower of the generic type does not satisfactorily close off the table top in the unused state and is impractical to handle.

The push-in part can be lowered into a table top, can be pushed in a horizontal direction into a vertical equipment plate or can be pushed upward into a bottom plate of a suspended part, for example of a kitchen cabinet. The invention is explained below on the basis of a push-in part which can be lowered into a table top.

SUMMARY OF THE INVENTION

The object of the invention is to provide a connection tower which has a flush termination of the table top in the unused state and is easy to handle.

This object is achieved according to the invention by the cover being capable of being swung up counter to a prestressing force about a hinge pin aligned parallel to the plane of an insert plate of a receptacle outlet insert on the insertion side of the insert plates.

The invention differs from the prior art to the extent that the cover terminates flush with the table top and can be swung up counter to a prestressing force. In this swung-up position, the connection tower can be pulled up with the aid of the cover, so that the receptacle outlet inserts are accessible. After inserting the plugs into the receptacle outlet inserts, the connection tower is lowered. The connection lines of the plugs reach through the end opening to the outside and are partially covered by the rim of the cover. This applies correspondingly to a bottom plate from which the push-in part can be pulled out downward and can be pushed in again upward.

A stable articulation of the cover is achieved by a top plate of the connection tower receiving the hinge pin in bearing fillets.

The prestressing force of the cover in the closed position is achieved by a leg spring which is located on the hinge pin being supported against the top plate and against the cover.

The handling and actuation of the cover is facilitated by the cover having a recess on the side facing away from the stop stage.

BRIEF DESCRIPTION OF THE DRAWING

An exemplary embodiment is explained with reference to the drawings, in which.

DESCRIPTION OF THE PREFERRED EMBODIMENT

Figure 1:
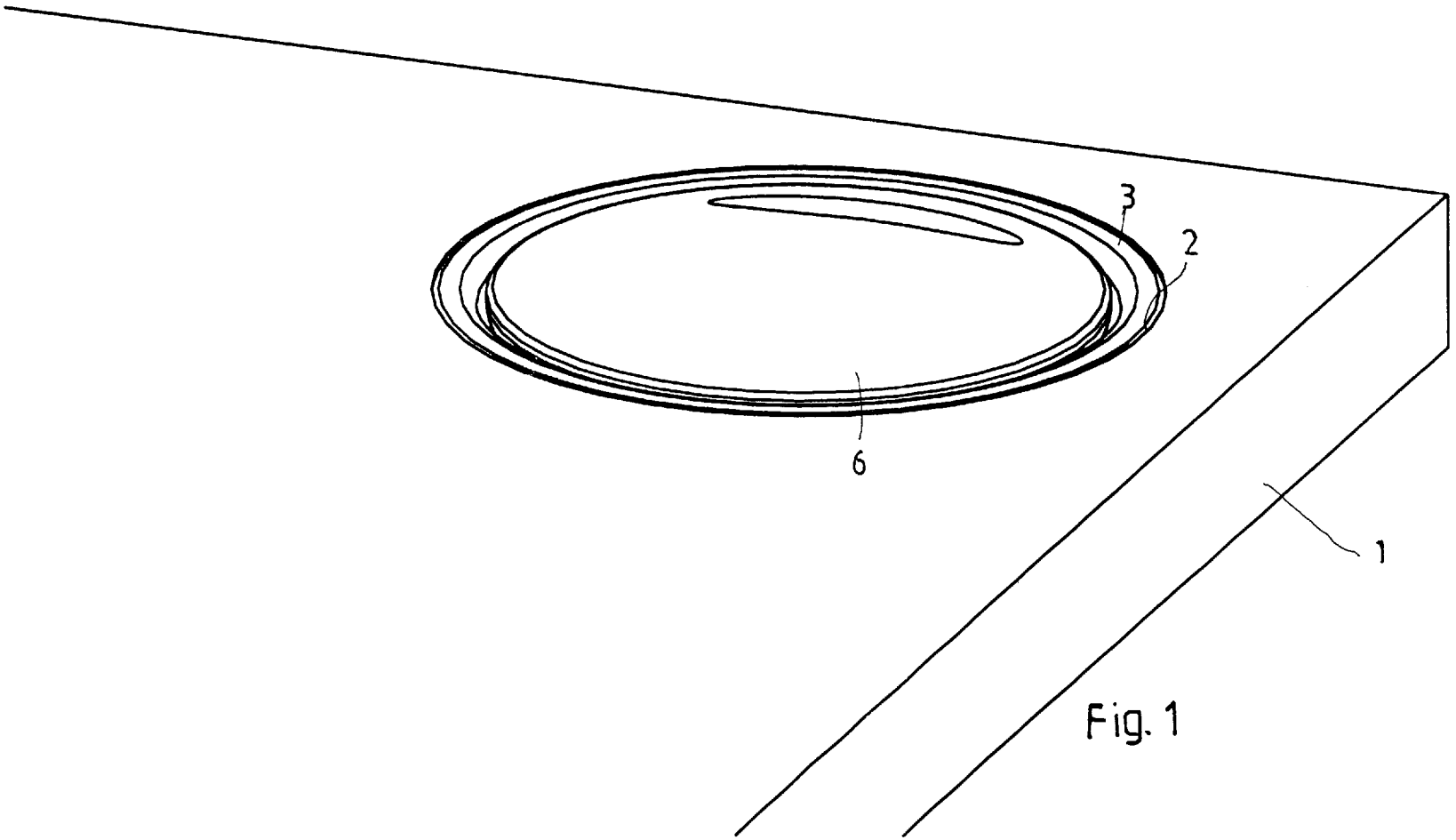
FIG. 1 shows a table top with a closed cover of a lowered connection tower.

FIG. 1 shows a corner of a table top 1 of a table, in particular of a conference table, a desk, a cubicle table or the like. The table top 1 has a cutout 2 of a circular cross section, which receives an annular surround 3. Guided displaceably in the vertical direction as a push-in part in the annular surround 3 is a connection tower 4. Pivotably mounted on the top plate 5 of the connection tower 4 is a cover 6, which in FIG. 1 is represented in the closed state.

The annular surround 3 bears with a flange 7 against the rim of the cutout 2. On the inner side of the annular surround 3 are two axial guide lugs 8, which in the exemplary embodiment represented are situated diametrically opposite each other. A threaded ring 10 can be screwed onto a thread 9 on the outer side of the annular surround 3, whereby the annular surround 3 can be firmly clamped to the table top 1.

Figure 3:
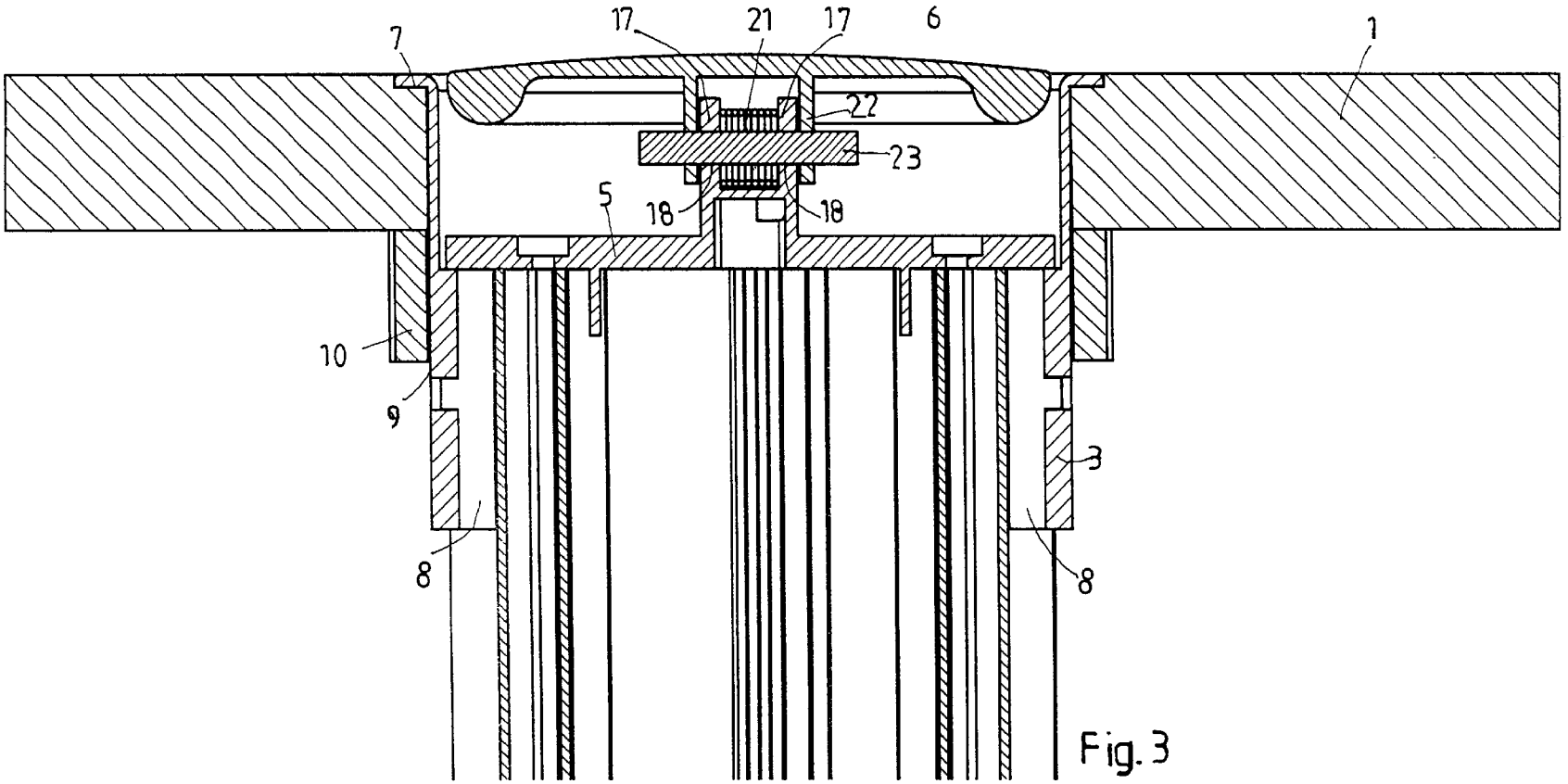
FIG. 3 shows a corresponding planar section.
Figure 4:
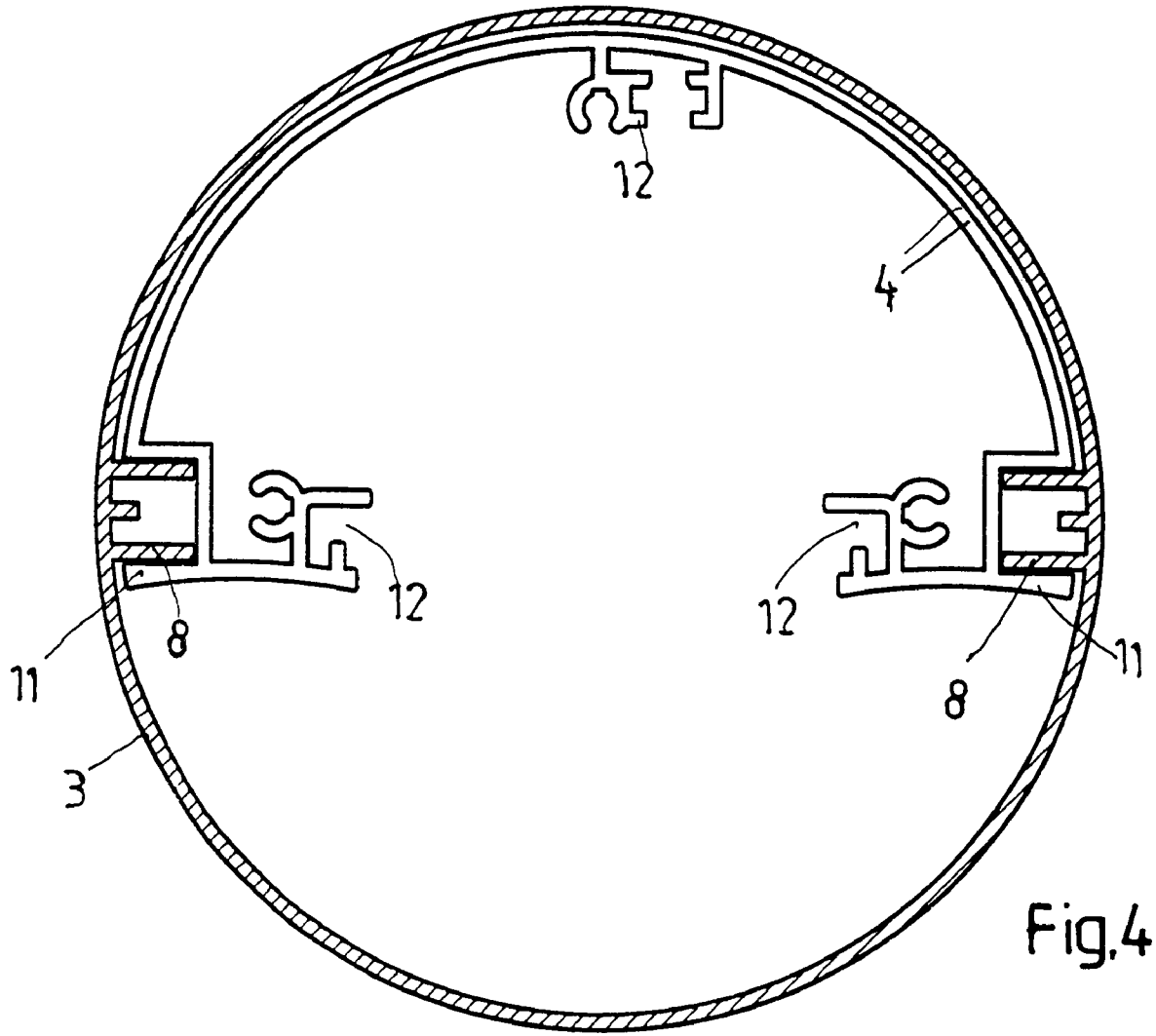
FIG. 4 shows a planar section perpendicular to the axis of the connection tower.
Figure 6:
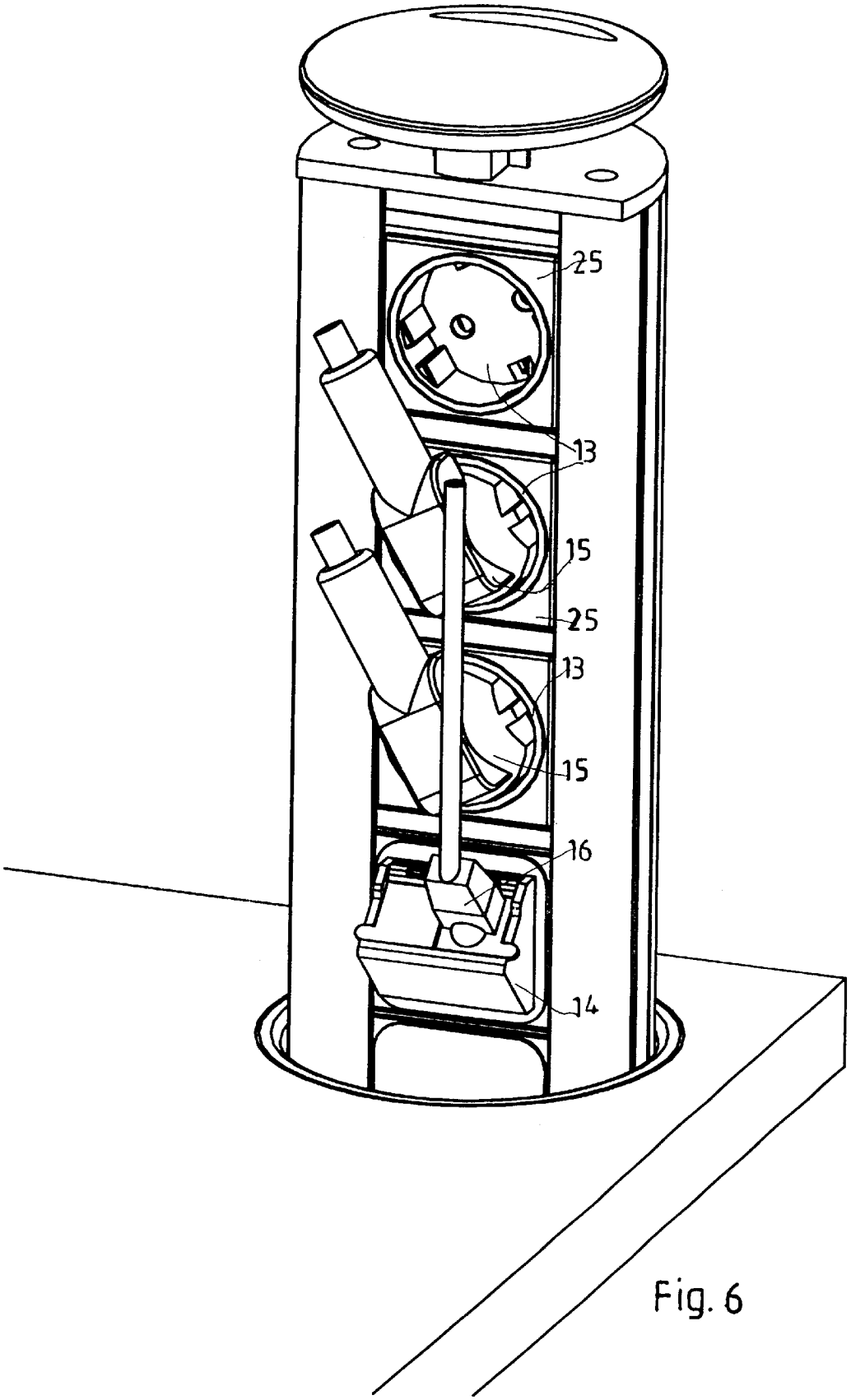
FIG. 6 shows the connection tower in the pulled-out state.
Figure 7:
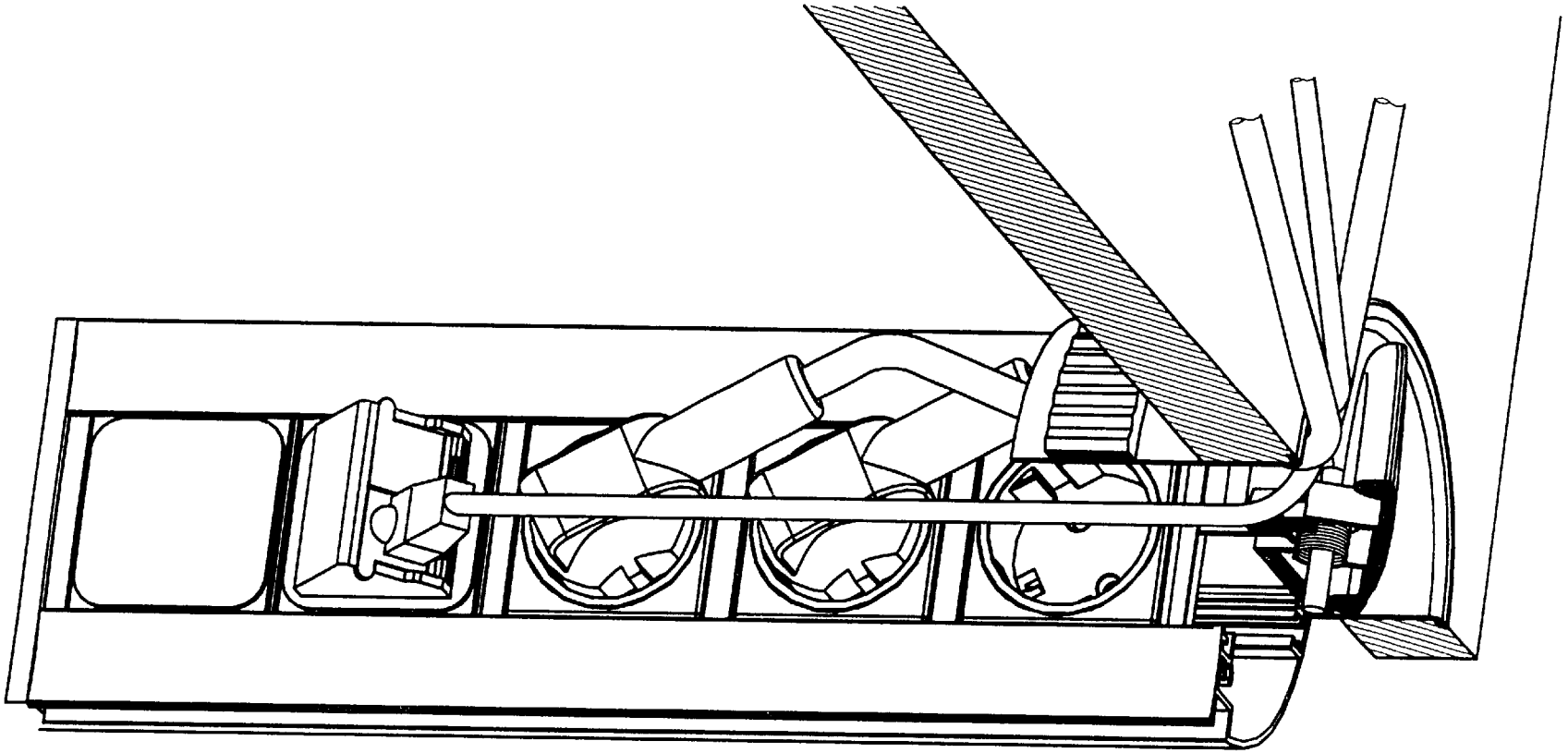
FIG. 7 shows the connection tower provided with plugs in the lowered state and FIG. 8 shows the lowered connection tower with plugs and the cover swung up.

The connection tower 4 comprises a profiled portion with guide rails 11, which can be fitted onto the guide lugs 8. The connection tower 4 receives in receiving profiles 12 receptacle outlet inserts 13 for system voltage connections and receptacle outlet inserts 14 for information connections, which are known and are not explained in detail. In FIGS. 6 and 7, system voltage plugs 15 and information plugs 16 are depicted. The connection lines of the receptacle outlet inserts 13 and 14 are led away downward. The top end of the connection tower 4 is closed off by the top plate 5, which according to FIG. 3 rests on the extreme ends of the guide lugs 8 and limits the pushing in of the connection tower 4. At the lower end of the connection tower 4 there is likewise a stop piece (not shown), which interacts with the guide lugs 8 and limits the pulling out of the connection tower 4.

The top plate 5 has in the center two upwardly pointing bearing fillets 17 which are aligned parallel to each other and have apertures 18. On the side adjacent to the receptacle outlet inserts, the bearing fillets 17 are connected by a stop stage 19. Furthermore, there is a receptacle 20 for a leg of a leg spring 21.

The cover 6 grips with a surround-shaped attachment 22 over the bearing fillets 17. The attachment 22 likewise has a receptacle (not shown) for a leg of the leg spring 21. The attachment 22 and the bearing fillets 17 are connected by a hinge pin 23. The leg spring 21 prestresses the cover in the closure position, the attachment 22 being located on the stop stage 19 according to FIG. 2. For the actuation of the cover 6, a recess 24 is formed into the surface of the cover such that it lies opposite the stop stage 19.

Figure 2:
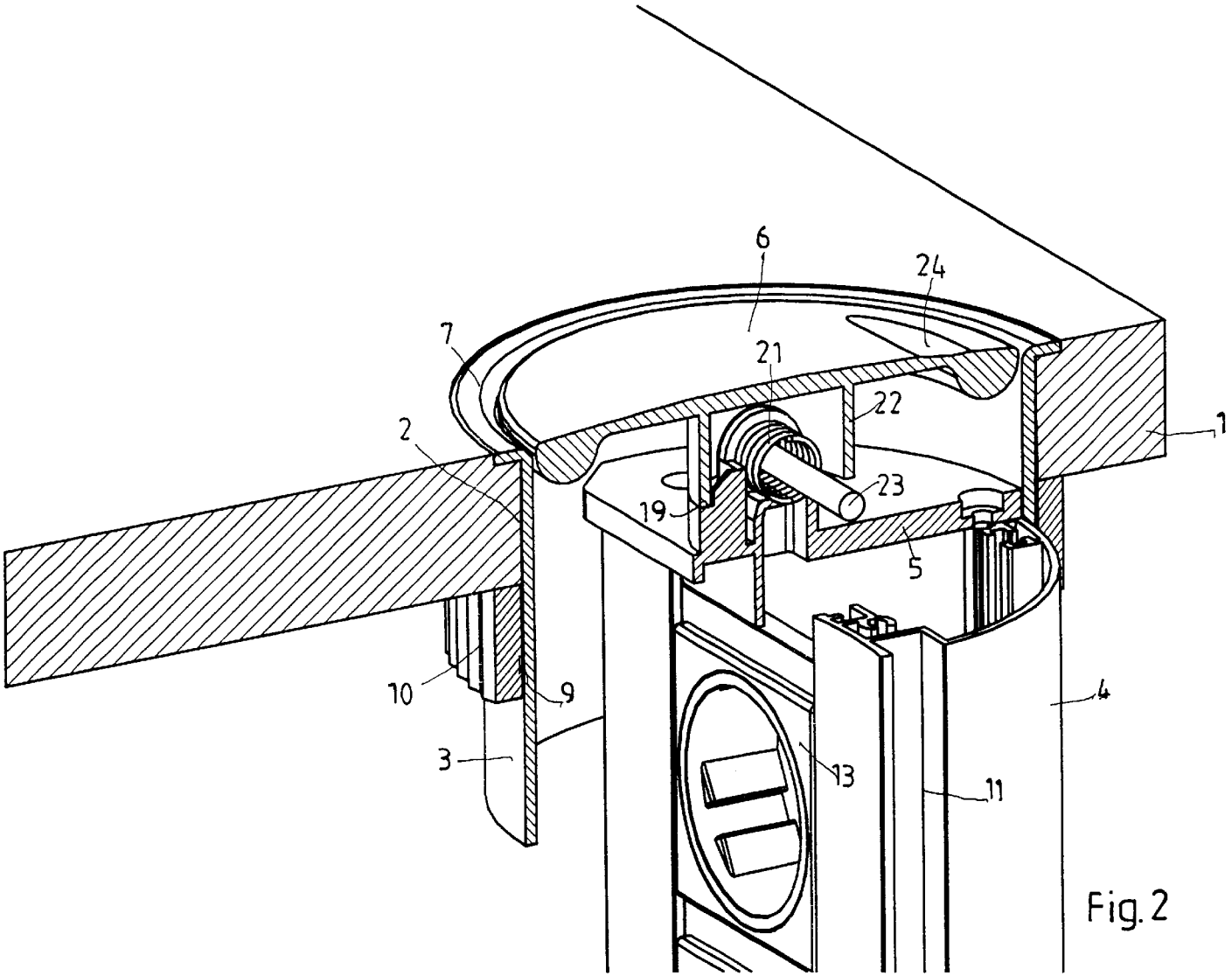
FIG. 2 shows a perspective taken in section in a radial plane with respect to the axis of the cover.
Figure 5:
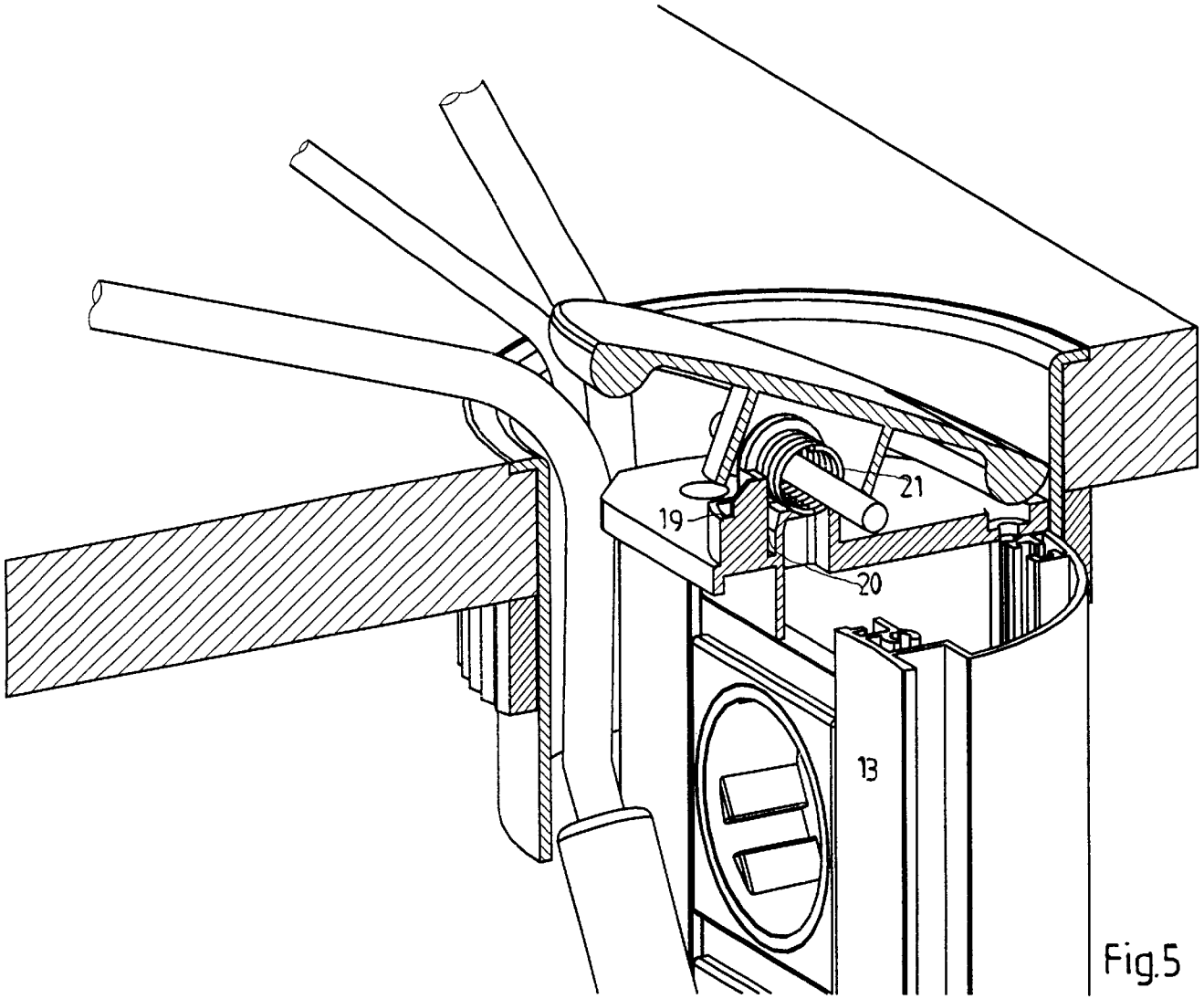
FIG. 5 shows a section corresponding to FIG. 2 with the cover swung up.

FIGS. 1 and 2 show the connection tower with the cover 6 closed. By pressing on the recess 24, the cover 6 is moved into the opening position according to FIG. 5, so that it is possible to reach under the rim of the cover. The connection tower 4 is pulled upward into the position according to FIG. 6 by pulling on the cover 6. Now, the receptacle outlet inserts 13 and 14 are accessible, so that the required number of system voltage plugs 15 and information plugs 16 can be inserted.

Figure 8:
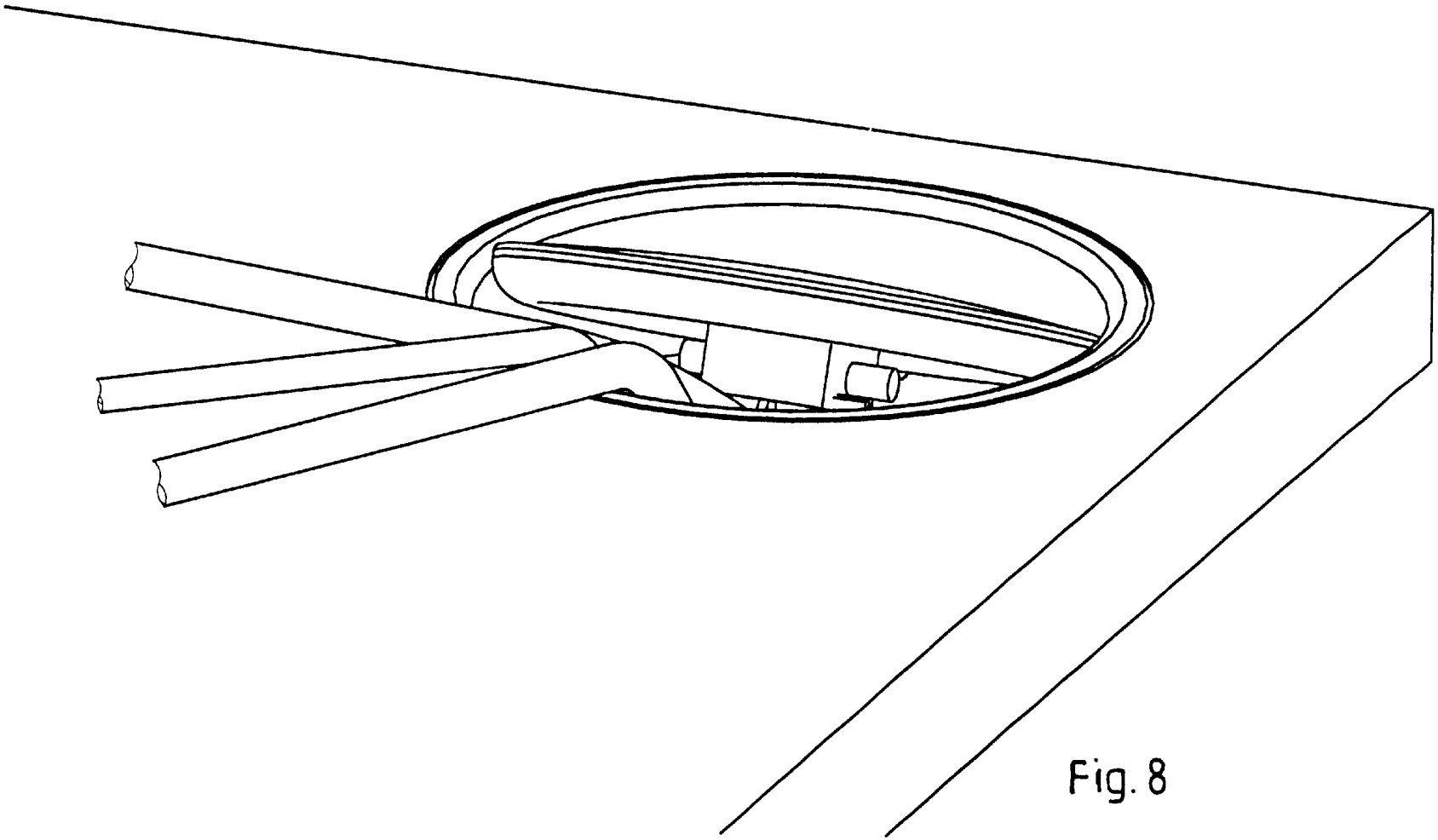

The connection tower 4 is pushed into the annular surround 3, so that the lines emerging from the front face are covered by the cover 6. The cover 6 is only partially closed, cf. FIGS. 5 and 8.

We claim the following:

1. An electrical connection tower as a push-in part with a plurality of receptacle outlet inserts for system voltage connections and for information connections, an annular surround which is recessed in a table top engaging with guides in rails of the connection tower and a cover arranged on the top of the connection tower closing off the top side of the annular surround, wherein the cover can be swung up counter to a prestressing force about a hinge pin aligned parallel to the plane of an insert plate of a receptacle outlet insert on the insertion side of the insert plates.

2. The connection tower as claimed in claim 1, wherein a top plate of the connection tower receives the hinge pin in bearing fillets.

3. The connection tower as claimed in claim 2, wherein an attachment of the cover is supported against a stop stage of the top plate.

4. The connection tower as claimed in claim 2, wherein a leg spring located on the hinge pin is supported against the top plate and against the cover.

5. The connection tower as claimed in claim 4, wherein an attachment of the cover is supported against a stop stage of the top plate.

6. The connection tower as claimed in claim 5, wherein the cover has a recess on the side facing away from the stop stage.

* * * * *